US008242678B2

(12) United States Patent
Itou et al.

(10) Patent No.: US 8,242,678 B2
(45) Date of Patent: Aug. 14, 2012

(54) AUTOMOTIVE DISCHARGE LAMP

(75) Inventors: Ryo Itou, Imabari (JP); Makoto Deguchi, Imabari (JP); Syuhei Abe, Imabari (JP); Hisashi Yoshida, Imabari (JP); Masahiro Doi, Imabari (JP)

(73) Assignee: Harison Toshiba Lighting Corp., Imabari-shi (JP)

( * ) Notice: Subject to any disclaimer, the term of this patent is extended or adjusted under 35 U.S.C. 154(b) by 28 days.

(21) Appl. No.: 12/867,520

(22) PCT Filed: Dec. 10, 2008

(86) PCT No.: PCT/JP2008/072370

§ 371 (c)(1),
(2), (4) Date: Aug. 13, 2010

(87) PCT Pub. No.: WO2009/101743

PCT Pub. Date: Aug. 20, 2009

(65) Prior Publication Data

US 2010/0315003 A1 Dec. 16, 2010

(30) Foreign Application Priority Data

Feb. 14, 2008 (JP) ..... 2008-033177
Apr. 30, 2008 (JP) ..... 2008-118232

(51) Int. Cl.
*H01J 5/50* (2006.01)

(52) U.S. Cl. ..... 313/364; 313/637; 313/573; 313/312

(58) Field of Classification Search ..... 313/17, 313/573, 634, 324, 312, 637
See application file for complete search history.

(56) References Cited

U.S. PATENT DOCUMENTS

| | | | | |
|---|---|---|---|---|
| 5,726,532 | A * | 3/1998 | Wittig et al. | 313/636 |
| 5,986,413 | A | 11/1999 | Zijlman | |
| 6,624,580 | B2 | 9/2003 | Kanegae et al. | |
| 7,893,623 | B2 * | 2/2011 | Haacke | 313/595 |
| 2005/0248279 | A1 * | 11/2005 | Lambrechts et al. | 313/640 |
| 2007/0057610 | A1 | 3/2007 | Allen et al. | |
| 2008/0093991 | A1 | 4/2008 | Tu | |
| 2008/0185967 | A1 | 8/2008 | Haacke | |

(Continued)

FOREIGN PATENT DOCUMENTS

EP 0 570 068 A1 11/1993

(Continued)

OTHER PUBLICATIONS

Extended Supplementary European Search Report issued on May 2, 2011 in corresponding European Application No. 08 87 2446.

(Continued)

*Primary Examiner* — Peter Macchiarolo
(74) *Attorney, Agent, or Firm* — Oblon, Spivak, McClelland, Maier & Neustadt, L.L.P.

(57) ABSTRACT

An automotive discharge lamp, having an inner tube including a light emitting unit having a first space therein and seal portions formed on the light emitting unit, a discharge medium containing a first gas enclosed in the first space, a metal foil sealed in the seal portions, electrodes with one end connected to the metal foil and other end extended into the first space, and an outer tube connected to the inner tube to form a second space between the outer tube and the inner tube, wherein the second space has a second gas enclosed therein and the oxygen concentration in the second space is 1.0 volume % or less.

5 Claims, 8 Drawing Sheets

U.S. PATENT DOCUMENTS

| | | | | |
|---|---|---|---|---|
| 2009/0129070 | A1 | 5/2009 | Wajata | |
| 2010/0019642 | A1 | 1/2010 | Allen et al. | |
| 2010/0045184 | A1 | 2/2010 | Deguchi et al. | |
| 2011/0031878 | A1 * | 2/2011 | Haacke et al. | 313/570 |

FOREIGN PATENT DOCUMENTS

| | | | |
|---|---|---|---|
| EP | 2 086 001 | A1 | 8/2009 |
| JP | 56 65453 | | 6/1981 |
| JP | 7 85839 | | 3/1995 |
| JP | 2004 134219 | | 4/2004 |
| JP | 3596812 | | 12/2004 |
| JP | 2007042621 | A * | 2/2007 |
| JP | 2007 179998 | | 7/2007 |
| JP | 2007-184130 | | 7/2007 |
| JP | 2008 84550 | | 4/2008 |
| WO | WO 2006/008707 | A1 | 1/2006 |
| WO | 2006 126144 | | 11/2006 |
| WO | WO 2007/004663 | A1 | 1/2007 |

OTHER PUBLICATIONS

Office Action issued Dec. 6, 2011, in Japanese Patent Application No. 2008-033177.

* cited by examiner

| | | Gas pressure (atm) | | | |
|---|---|---|---|---|---|
| | | 0.1 | 0.3 | 0.5 | 0.7 |
| Oxygen concentration (%) | 0.1 | 30/30 | 30/30 | 25/30 | 15/30 |
| | 1.0 | 30/30 | 30/30 | 20/30 | 11/30 |
| | 2.0 | 19/30 | 15/30 | 5/30 | 0/30 |

| Pressure of First Gas (atm) | Single operation startability |
|---|---|
| 9 | 9/10 |
| 10 | 8/10 |
| 11 | 4/10 |
| 12 | 3/10 |
| 13 | 1/10 |
| 14 | 1/10 |

| Distance D | Distance D' | Rise time | | | |
|---|---|---|---|---|---|
| | | 250 ns | 200 ns | 100 ns | 60 ns |
| 0.40 mm | 0.40 mm | 10 % | 16 % | 24 % | 28 % |
| 0.45 mm | 0.35 mm | 8 % | 12 % | 20 % | 22 % |
| 0.50 mm | 0.30 mm | 4 % | 10 % | 14 % | 20 % |
| 0.55 mm | 0.25 mm | 0 % | 0 % | 2 % | 4 % |
| 0.60 mm | 0.20 mm | 0 % | 0 % | 0 % | 0 % |
| 0.65 mm | 0.15 mm | 0 % | 0 % | 0 % | 0 % |

AUTOMOTIVE DISCHARGE LAMP

TECHNICAL FIELD

The present invention relates to a discharge lamp used for vehicle headlights.

BACKGROUND

Discharge lamps used for vehicle headlights are disclosed in JP-B2 3596812 (Patent Registration) (hereinafter referred to as Patent Reference 1) and JP-A 2007-179998 (KOKAI) (hereinafter referred to as Patent Reference 2). The discharge lamps have a double tube structure of an inner tube and an outer tube attached to cover the inner tube. The inner tube has a light-emitting unit in which a rare gas and a metal halide are enclosed, and seal portions which are formed at either end of a luminous tube, and seal a metal foil and an electrode.

It is known that this type of discharge lamp is started with difficulty because a voltage of several kV to several tens of kV is required to start the lamp. Patent Reference 1 discloses that a gas capable of inducing a dielectric barrier discharge is enclosed into a space comprising an inner tube and an outer tube, and the dielectric barrier discharge is induced at start up to decrease a starting voltage, thereby enabling to start readily.

Patent Reference 1: JP-B2 3596812 (Patent Registration)

Patent Reference 2: JP-A 2007-179998 (KOKAI)

DISCLOSURE OF THE INVENTION

Problems to be Solved by the Invention

But, a discharge lamp not containing mercury, a discharge lamp having a rare gas enclosed under high pressure, and the like have inferior startability. Therefore, even if the means described in Patent Reference 1 are taken, there is a problem of difficulty in start up.

The object of the present invention is an automotive discharge lamp excelling in startability.

Means for Solving the Problems

To achieve the object, according to an aspect of the present invention, an automotive discharge lamp has an inner tube including a light emitting unit having a first space therein and seal portions formed on the light emitting unit, a discharge medium containing a first gas enclosed in the first space, a metal foil sealed in the seal portions, electrodes with one end connected to the metal foil and other end extended into the first space, and an outer tube connected to the inner tube to form a second space between the outer tube and the inner tube, wherein: the second gas contains oxygen in a concentration of 1.0% or less.

Effects of the Invention

The present invention can provide an automotive discharge lamp excelling in startability.

MODE FOR CARRYING OUT THE INVENTION

First Embodiment

Figure 1:
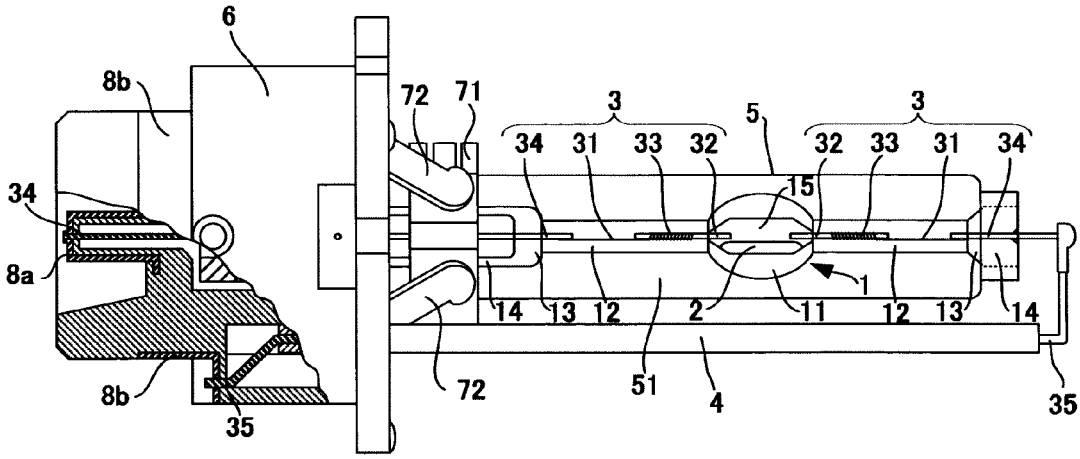
FIG. 1 is a side view illustrating a first embodiment of the automotive discharge lamp according to the invention.

A first embodiment of the automotive discharge lamp of the invention is described below with reference to the drawings. FIG. 1 is a side view illustrating the first embodiment of the automotive discharge lamp of the invention.

The automotive discharge lamp shown in FIG. 1 is a so-called D4 type discharge lamp and has an inner tube 1 as a main portion. The inner tube 1 has an elongate shape in a lamp tube axis direction with an almost elliptical light-emitting unit 11 formed at its approximate center. Plate-like seal portions 12 are formed at both ends of the light-emitting unit 11, and cylindrical portions 14 are continuously formed at both ends of the plate-like seal portions 12 via boundary portions 13. The inner tube 1 is desirably made of, for example, a material such as quartz glass having heat resistance and translucency.

A first space 15 which has an almost cylindrical shape at the center and both tapered ends is formed within the light-emitting unit 11. The first space 15 has a volume of 10 $mm^3$ to 40 $mm^3$ and more preferably 20 $mm^3$ to 30 $mm^3$ when the lamp is used for vehicle headlights.

A discharge medium is sealed in the first space 15. The discharge medium is comprised of a metal halide 2 and a first gas.

The metal halide 2 is constituted by sodium iodide (NaI), scandium iodide ($ScI_3$), zinc iodide ($ZnI_2$) and indium bromide (InBr). The metal halide 2 is not limited to the above combination, and halides of tin and potassium may be added. The combination of halogens to be bonded to the metal may be changed.

For the first gas, xenon is used. The first gas has a higher light-emitting property such as a total luminous flux as its pressure is increased. Therefore, for example, a sealing pressure can be set to 11 atm or more, and preferably 13 atm or more, at normal temperature (25° C.). The upper limit of the pressure of the first gas is about 20 atm due to manufacturing reasons today. The pressure of the first gas can be calculated by breaking the boundaries between the light-emitting unit 11 and the seal portions 12 under water, collecting and measuring the gas contained in the first space 15, and measuring the volume of the first space 15. As the first gas, neon, argon and krypton can be used instead of the xenon, and they can also be used in combination.

The discharge medium does not substantially contain mercury. This "does not substantially contain mercury" means that it is optimum that the amount of sealed mercury is 0 mg, but it is allowed to contain mercury in an amount equivalent to substantially no enclosure, e.g., less than 2 mg/ml, and preferably not more than 1 mg/ml, in comparison with a conventional mercury-containing discharge lamp.

Electrode mounts 3 are attached by sealing in the seal portions 12. Each electrode mount 3 comprises a metal foil 31, an electrode 32, a coil 33 and a lead wire 34.

The metal foil 31 is a thin metal plate made of, for example, molybdenum.

The electrodes 32 are a discharge electrode made of, for example, so-called thoriated tungsten which is made of thorium-oxide doped tungsten. One end of one of the electrodes 32 is connected to an end of the metal foil 31 which is on the side of the light-emitting unit 11, and the other end is arranged within the first space 15 to face one end of the other of the electrode 32 with a prescribed interelectrode distance between them. For the vehicle headlights, the interelectrode distance is desirably about 4.0 mm to 4.4 mm in appearance, namely it is not an actual distance but an appearance distance in the lamp. The shape is not limited to a straight rod shape but may have a non-straight rod shape having a large diameter at a leading end or a shape having a different size between a pair of electrodes such as a direct current lighting type. And, the material may be doped tungsten or rhenium-tungsten.

The coil 33 is made of a metal wire made of, for example, doped tungsten and wound in a spiral shape around the shaft portion of the electrode 32 which is sealed in the seal portions 12. To design the coil, the coil pitch is not more than 300%, the coil-wound length is not less than 60% with respect to the electrode sealing length, and it is desirable that the coil 33 is not wound around the shaft portion of the electrode 32 connected to the metal foil 31.

The lead wire 34 is a metal wire made of, for example, molybdenum. Its one end is connected to the metal foil 31 which is on the opposite side of the light-emitting unit 11, and the other end is extended to the exterior of the inner tube 1 along the tube axis. One end of an L-shape support wire 35 made of, for example, nickel is connected to the lead wire 34 which is extended toward the front end of the lamp. A sleeve 4 made of, for example, ceramics is attached to a part of the support wire 35, which is parallel to the tube axis. One end of the sleeve 4 is inserted into a hole formed in a socket 6 described later but may be fixed to the socket 6 by a press fitting or adhering method. Thus, it can be prevented that the sleeve 4 collides against the L-shape portion of the support wire 35 due to its sliding in the tube axis direction caused by vibration, transportation or the like, thereby preventing the lead wire 34 and the support wire 35 from being disconnected from each other.

A cylindrical outer tube 5 is disposed to cover the exterior of the above-configured inner tube 1 concentrically with the inner tube 1 along the tube axis. They are connected by welding both ends of the outer tube 5 to the vicinity of the cylindrical portion 13 of the inner tube 1 to form an air-tight second space 51 between the inner tube 1 and the outer tube 5. A second gas containing an oxygen concentration of 1 volume % or less is enclosed in the second space 51. As the second gas, one type of gas selected from neon, argon, xenon and nitrogen or a mixture gas thereof can be used. The second gas desirably has a gas pressure of 0.3 atm or less. The outer tube 5 is desirably configured of a material having an ultraviolet shielding characteristic by adding, for example, an oxide of titanium, cerium, aluminum or the like to quartz glass. If desired, a light-shielding film for light distribution control may be formed on the outside surface of the outer tube 5.

Figure 2A:
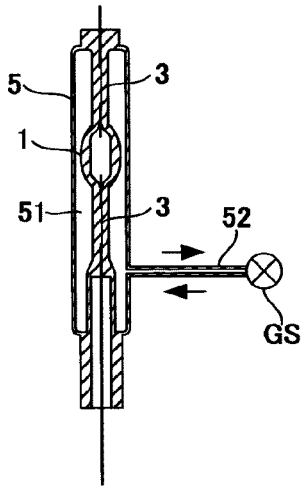
FIG. 2A is a diagram illustrating one example of a method of enclosing a second gas according to the invention.
Figure 2B:
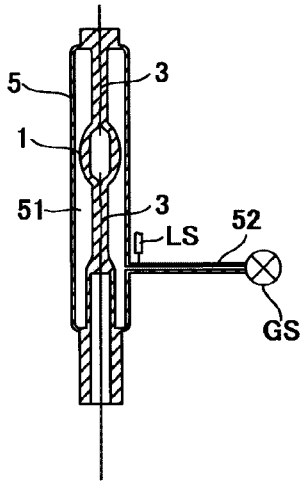
FIG. 2B is a diagram illustrating the example of the method of enclosing the second gas according to the invention.
Figure 2C:
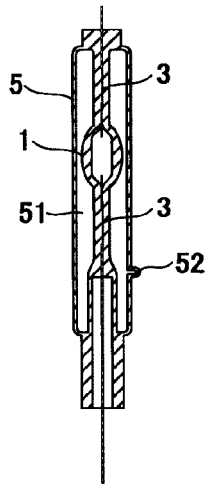
FIG. 2C is a diagram illustrating the example of the method of enclosing the second gas according to the invention.

To decrease the oxygen concentration of the second gas, it is desirable to use a gas in which the oxygen content is decreased previously or to prevent impure gas generated from glass or the like from entering the second space 51 as much as possible until the inner tube 1 and the outer tube 5 are sealed airtight. The pressure of the second gas can also be decreased by preventing the impure gas generated from glass or the like from entering the second space 51 as much as possible. For example, after the inner tube 1 and the outer tube 5 are sealed airtight, the second space 51 is degassed and the second gas is introduced by a gas removing/introducing device GS through an exhaust pipe 52 formed on the outer tube 5 as shown in FIG. 2A. Then, a part of the exhaust pipe 52 about 1.0 mm away from the outer tube 5 is heated to melt and shrink sealed by a laser LS as shown in FIG. 2B and chipped as shown in FIG. 2C. Then, heating is performed by a burner (not shown) or the like until the outer tube 5 has a surface temperature of 700 to 800° C. to react oxygen present in the second space 51 and organic impurities contained in the glass and the like, so that the oxygen concentration and the gas pressure can be easily set low. The exhaust pipe 52 after chipping becomes a projection of about 0.5 mm and does not influence on light distribution and the like.

And, the socket 6 is connected to one end of the inner tube 1 to which the outer tube 5 is connected. Such connection is made by attaching a metal band 71 to the outer circumferential surface of the outer tube 5 and pinching the metal band 71 with metal tongue-shaped pieces 72 formed on the socket 6. And, the socket 6 has a bottom terminal 8*a* formed on its bottom and a side terminal 8*b* on its side, and they are respectively connected with the lead wire 34 and the support wire 35.

The above-configured automotive discharge lamp is lit by connecting a lighting circuit to the bottom terminal 8*a* and the side terminal 8*b*. This lamp for vehicle headlights is arranged with the tube axis in a substantially horizontal state and lit with electric power of about 35 W at a stable time and about 75 W at the time of start up which is not less than two times in comparison with the power at the stable time.

Figure 3:
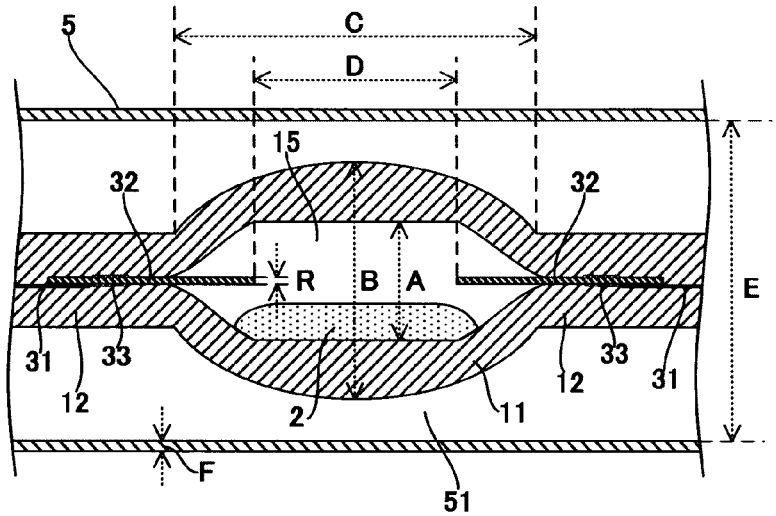
FIG. 3 is a diagram illustrating one example of the automotive discharge lamp of FIG. 1.

Now, specifications of the automotive discharge lamp of the invention are described with reference to FIG. 3. FIG. 3 is a diagram illustrating one example of the automotive discharge lamp of FIG. 1.

Example 1

Inner tube 1: Made of quartz glass, first space 15 having inner volume=27 $mm^3$, inner diameter A=2.5 mm, outer diameter B=6.2 mm, longitudinal sphere length C=7.8 mm, Metal halide 2: $ScI_3$, NaI, $ZnI_2$ and InBr (=1:1.5:0.4:0.01), total=0.4 mg, First gas: Xenon, gas pressure=13.5 atm, Mercury: 0 mg, Metal foil 31: Made of molybdenum, Electrode 32: Made of thoriated tungsten, diameter R=0.38 mm, interelectrode distance D=3.74 mm (real interelectrode distance=4.32 mm), Coil 33: Made of doped tungsten, pitch=200%, Lead wire 34: Made of molybdenum, diameter=0.6 mm, Outer tube 5: Inner diameter E=7.0 mm, wall thickness F=1.0 mm, Second gas: Nitrogen, oxygen concentration=0.1%, gas pressure=0.1 atm.

Figure 4:
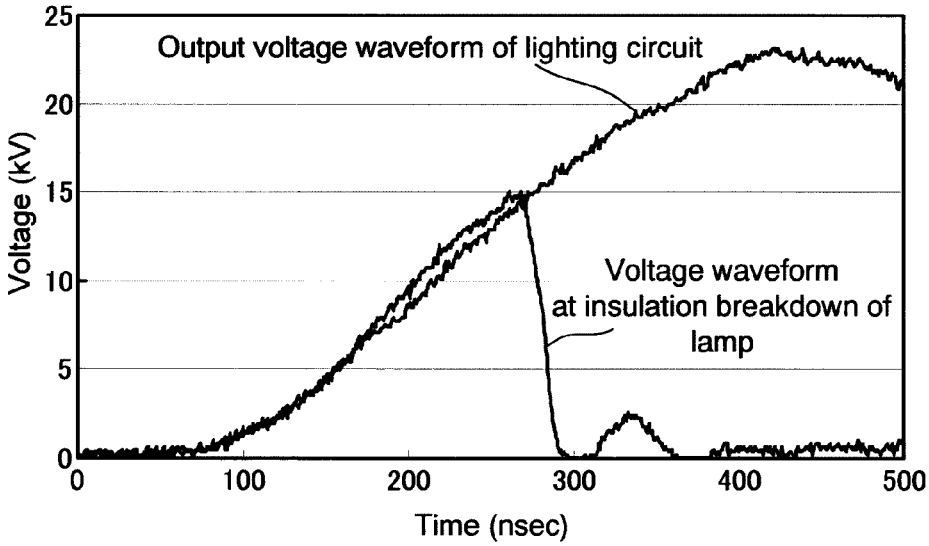
FIG. 4 is an output voltage waveform of a lighting circuit and an example thereof.

For the lamp of this example, a lighting circuit which continuously outputs a voltage waveform having a start pulse voltage of 23.4 kV and rise time (time to become 10% to 90% of start pulse voltage) of 250 nsec was used as shown in FIG. 4 to test whether the lamp starts to light up. It was confirmed as a result that even the lamp of this example having no mercury and the first gas of a high pressure suffers from insulation breakdown at about 15 kV and lights up. The lamp had the insulation breakdown when a first pulse was applied. When the lamp is used for vehicle headlights, the start of the lamp is generally stopped in terms of safety if the lamp is not lit even when the pulse having the voltage waveform as shown in FIG. 4 is applied to the lamp for a predetermined number of times. Therefore, it is very significant to have the results that the lamp is lit by a first pulse as in this example.

Figures 5, 6, 7:
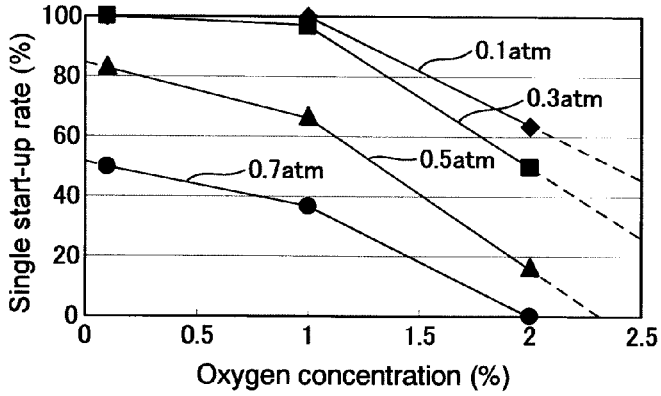
FIG. 5 is a diagram illustrating single operation startability when the oxygen concentration and gas pressure of a second gas are varied.
FIG. 6 is a graphed diagram of FIG. 4.
FIG. 7 is a diagram illustrating relationships between the pressure of the first gas and single operation startability.

Tests to verify how many lamps are lit by a single operation among thirty lamps with the oxygen concentration and gas pressure of the second gas (nitrogen) varied. The results are shown in FIG. 5 and FIG. 6. The oxygen concentration of the second gas was measured by thermal desorption analysis using a thermal desorption spectrometer WA1000S/W manufactured by ESCO Ltd. The pressure of the second gas was measured by the same method as that used for the first gas.

It is seen from the results that single operation start is easy as the second gas has a lower oxygen concentration and gas pressure. Particularly, it is apparent from FIG. 6 that the oxygen concentration is more effective for startability, and there is a large difference in single operation startability between the oxygen concentration of 1.0 volume % and 2.0 volume %. Specifically, it is apparent that the lamp having an oxygen concentration of 1.0 volume % or less is superior in startability to the lamp having an oxygen concentration of 2.0 volume %. Its cause is not certain but it is presumed that the dielectric barrier discharge is disturbed when the oxygen concentration is high. Therefore, the oxygen concentration contained in the second gas is desirably 1.0 volume % or less. Since the single operation startability is good when the pressure of the second gas is lower, the gas pressure is desirably 0.3 atm or less. Meanwhile, it is presumed from the tendency of FIG. 5 that the effects are increased furthermore when the oxygen concentration in the second gas and the gas pressure become closer to zero. The lower limit is not set, but the production limit from time to time is the lower limit. And, substantially the same results were obtained even when the second gas is neon, argon, krypton, xenon or a mixture gas thereof.

The present invention is an invention which is particularly advantageous for a mercury-free automotive discharge lamp in which the first gas has a high pressure. This is because a mercury free discharge lamp having a higher pressure first gas tends to have inferior startability. Specifically, as shown in FIG. 7 (test conditions: using a lamp sealing xenon as the first gas, and nitrogen having the oxygen concentration of 10 volume % and 0.7 atm as the second gas, and it was lit by applying the pulse of FIG. 4), single operation start tends to become difficult when the pressure of the first gas is 11 atm or more, and especially 13 atm or more. In other words, the lamp has a higher possibility that the voltage required for startup becomes higher than the voltage inputted from the lighting circuit to the lamp, but the present invention can provide the above lamp with good startability.

Therefore, this embodiment can realize the automotive discharge lamp excelling in startability by enclosing nitrogen having an oxygen concentration of 1.0 volume % or less as the second gas within the second space even when mercury is not contained as the discharge medium and a high-pressure xenon is enclosed as the first gas within the first space 15. If the pressure of the second gas is 0.3 atm or less, better startability can be realized.

Second Embodiment

Figure 8:
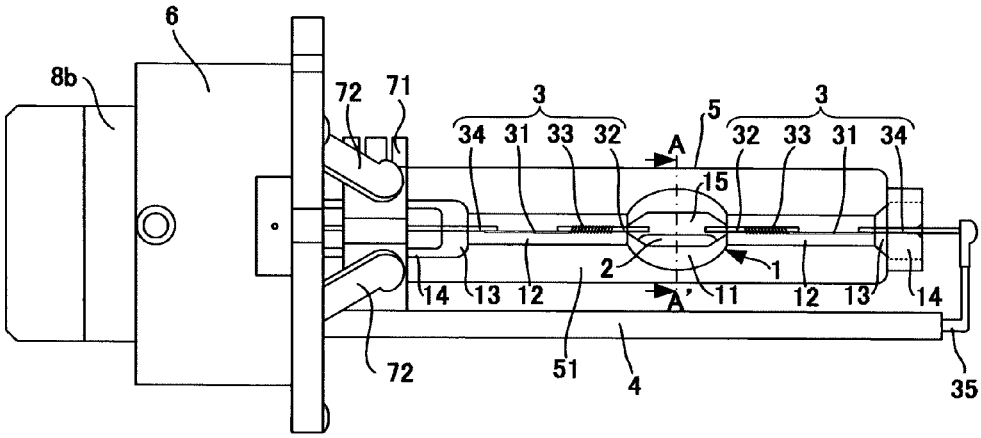
FIG. 8 is a side view illustrating a second embodiment of the discharge lamp according to the invention.
Figure 9:
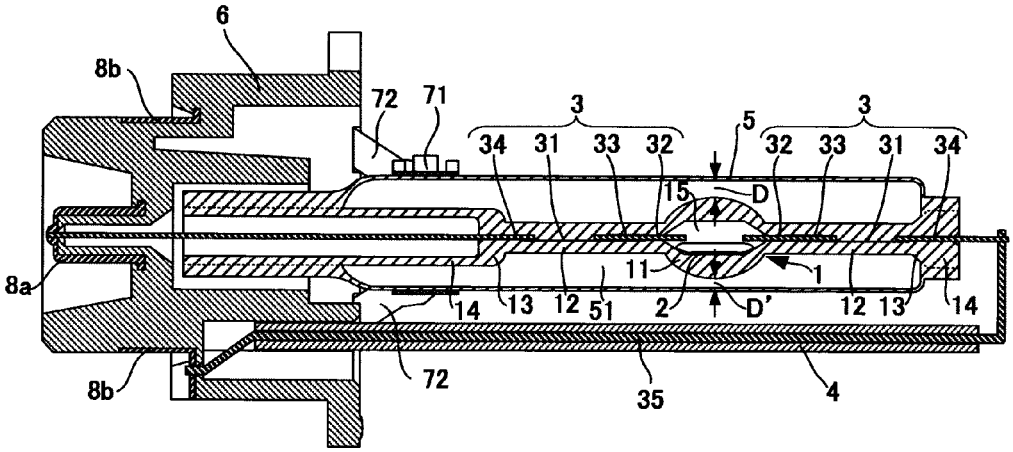
FIG. 9 is a sectional view illustrating the second embodiment of the discharge lamp according to the invention.
Figures 10, 11:
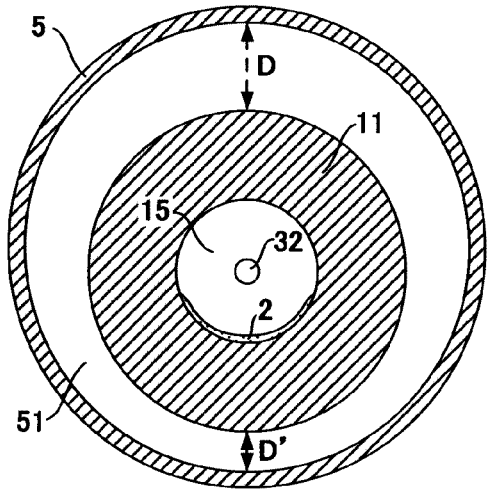
FIG. 10 is a sectional view taken along A-A' of a maximum outer diameter portion of the light-emitting unit of FIG. 1 as viewed from the direction of arrows.
FIG. 11 is a diagram illustrating an NG start occurrence rate when a distance D, a distance D' and a rise time are varied.

A second embodiment of the discharge lamp of the invention is described below. FIG. 8 is a side view illustrating the second embodiment of the discharge lamp of the invention. FIG. 9 is a sectional view illustrating the second embodiment of the discharge lamp of the invention. FIG. 10 is a sectional view taken along A-A' of a maximum outer diameter portion of the light-emitting unit of FIG. 8 as viewed from the direction of arrows.

It is apparent from FIGS. 8 to 10 that this embodiment basically adopts the same structure as that of the first embodiment, but it is apparent from FIGS. 9 and 10 that the inner tube 1 is offset downward with respect to the outer tube 5, and the distance D between the maximum outer diameter portion of the light-emitting unit 11 and the inner surface of the outer tube close to the portion is largest at the upper side and conversely smallest at the lower side. And the distance D (mm) is different on the point satisfying $D \geqq 0.55$. Other component elements similar to those of the first embodiment are denoted by like reference numerals, and their descriptions will be omitted.

The above second gas does not require that its contained oxygen concentration is 1.0% or less as in the first embodiment and may be larger than that. But, the startability of the discharge lamp can be improved by satisfying the above-described requirements.

Specifications of an example of the discharge lamp of the invention are described below.

Example 2

Light-emitting unit 11: Made of quartz glass, first space 15 having inner volume=26 $mm^3$, maximum inner diameter=2.5 mm, maximum outer diameter=6.2 mm, longitudinal sphere length=7.8 mm, Seal portion 12: Width=4.1 mm, thickness=2.8 mm, Metal halide 2: $ScI_3$, NaI, $ZnI_2$ and InBr (=1:1.5:0.4:0.01), total=0.4 mg, First gas: Xenon, gas pressure=13 atm, Mercury: 0 mg, Metal foil 31: Made of molybdenum, Electrode 32: Made of thoriated tungsten, diameter=0.38 mm, electrode length=7.5 mm, interelectrode distance in appearance=3.74 mm (real interelectrode distance=4.32 mm), Coil 33: Made of doped tungsten, pitch=200%, Lead wire 34: Made of molybdenum, diameter=0.6 mm, Outer tube 5: Inner diameter=7.0 mm, wall thickness=1.0 mm, Second gas: Nitrogen, gas pressure=0.1 atm, Maximum distance D=0.60 mm and minimum distance D'=0.20 mm between the maximum outer diameter portion of the light-emitting unit 11 and the outer tube 5.

Similar to the first embodiment, for the lamp of this example, a lighting circuit which continuously outputs a general voltage waveform having a start pulse voltage of 23.4 kV and rise time (time to become 10% to 90% of start pulse voltage) of 250 nsec was used as shown in FIG. 4 to test whether the lamp starts to light up. It was confirmed as a result that even the lamp normally requiring a starting voltage of about 18 kV carries out insulation breakdown at about 15 kV and lights up. And, the lamp had the insulation breakdown when a first pulse was applied. When the lamp is used for vehicle headlights, the start of the lamp is generally stopped in terms of safety if the lamp is not lit even when the pulse having the voltage waveform as shown in FIG. 4 is applied to the lamp for a predetermined number of times. Therefore, it is very significant to have the results that the lamp is lit by a first pulse as in this example.

Figure 12:
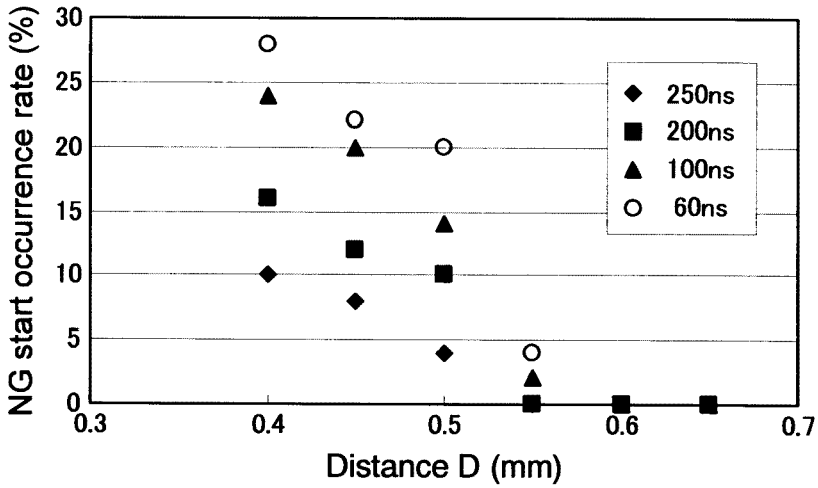
FIG. 12 is a graphed diagram of the results of FIG. 11.

Then, the NG start occurrence rate was tested while the distance D, the distance D' and the rise time were varied. The results are shown in FIG. 11, and the graphically-illustrated results are shown in FIG. 12. Test lamps are fifty. The NG start occurrence rate means that the lamps were not lit even when a high voltage pulse was applied or the lamps were lit by a high starting voltage of about 20 kV.

It is seen from the results that there is a tendency that the NG start occurrence rate decreases as the distance D increases. Especially, it is apparent from FIG. 12 that when the distance D is 0.55 mm or more, the NG start occurrence rate lowers considerably. When the distance D becomes 0.60 mm or more, start up can be made without occurring NG, even when the rise time is decreased. There is also a tendency that the NG start occurrence rate increases as the rise time decreases.

Figure 13:
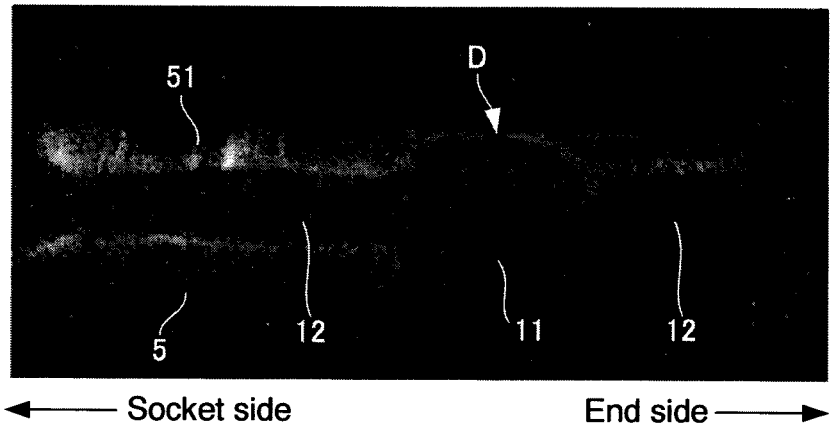
FIG. 13 is a diagram illustrating a dielectric barrier discharge when the lamp of an example is started.

The cause of varying the NG start occurrence rate depending on the distance D is relevant to the occurrence of the dielectric barrier discharge just after start up. It is seen from FIG. 13 showing an image taken by a CCD camera that the lamp of the example substantially carried out the dielectric barrier discharge at an upper side having a larger distance, immediately after start up. But a conventional lamp having distance D=distance D'=0.40 mm was occasionally confirmed that the dielectric barrier discharge did not occur. This tendency does not change even when a different type of second gas was used. In other words, the dielectric barrier discharge is caused from the vicinity of the seal portion 12 on a high-pressure side to the seal portion 12 on a low-pressure side via the light-emitting unit 11 as shown in the drawing, so that it is thought that if the distance D between the maximum outer diameter portion of the light-emitting unit 11 and the outer tube 5 is not large to some extent, the dielectric barrier discharge is hard to move through the portion. It is desirable from the above that the distance D is 0.55 mm or more, and preferably 0.60 mm or more. But, if the distance D becomes large, the temperature of the light-emitting unit 11 lowers, and luminous efficiency is decreased. Therefore, it is desirably designed within a range of 1.5 mm or less.

The distance D is not limited to the upper side of the light-emitting unit 11. For example, it may be at a lower side or a side portion. It is because the portion where the dielectric barrier discharge just after start up is generated is not limited to the upper side of the light-emitting unit. In other words, it is appropriate when at least one portion in the distance D (mm) between the maximum outer diameter portion of the light-emitting unit 11 and the inner side of the outer tube 5 close to the portion satisfies D≧0.55. But, in a case where the distance D is adjusted by offsetting the inner tube 1 against the outer tube 5 as in the example, it is desirable to configure so that the upper side of the light-emitting unit 11 satisfies the distance D≧0.55 mm by offsetting the inner tube 1 to the lower side to solve the problems of influences on optical characteristics resulting from a bulge at the top of the light-emitting unit and the floating of an arc within its life time. And, since the probability of occurrence of the dielectric barrier discharge increases as the pressure of the second gas is lower, the gas pressure is 0.7 atm or less and more desirably 0.3 atm or less.

To improve further the startability, it is desirable to combine the following structures.

Figure 14:
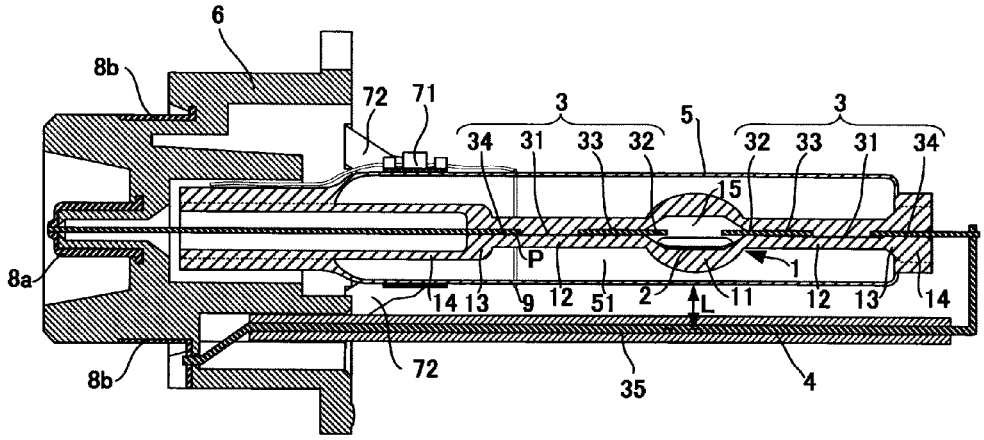
FIG. 14 is a diagram illustrating another preferable embodiment.

It is desirable to dispose an auxiliary electrode on the inner or outer circumferential surface of or to build in the outer tube 5 located at a part of the high-pressure side seal portion 12. It is to facilitate the generation of the dielectric barrier discharge on the high-pressure and low-pressure sides by locally concentrating an electric field. Especially, as shown in FIG. 14, a metal wire 10 made of nickel is wound around the outer circumferential surface of the outer tube 5 positioned within ±2.0 mm from a connecting part P of a high-pressure side metal foil 31 and a lead wire 34, and an end portion 10A of the metal wire 10 is extended to the space between the cylindrical wall in the socket 6 and the outer tube 5. Thus, an effect of lowering a starting voltage of 2 kV or more can be obtained in comparison with prior art. For the metal wire 10, aluminum, copper, iron, silver, gold or the like may be used instead of nickel. And, an auxiliary electrode may be formed by pasting, vapor depositing or the like of a metallic material. And, for the discharge lamp having a light-shielding film formed on the outside of the outer tube 5, the same effect can also be obtained by mixing a conductive material with the material for the light-shielding film.

It is desirable that a distance L between the support wire 35 and the outer surface of the outer tube 5 is decreased. It is to facilitate the generation of dielectric barrier discharge at start up by increasing an electric potential difference between the glass surfaces of the seal portions 12 and the glass surface of the outer tube 5. It was confirmed through the tests conducted by the inventors that when the distance L was 4.2 mm, probability of single operation start was about 50%, but when the distance L was 3.5 mm, single operation start was possible almost certainly. Therefore, the distance L is particularly desirable to be 3.5 mm or less.

Therefore, since this embodiment is configured such that the largest distance between the light-emitting unit 11 and the outer tube 5 is provided at the upper side and the distance D (mm) satisfies D≧0.55 by sealing nitrogen in the second space 51 and offsetting the inner tube 1 to the lower side against the outer tube 5, the probability of occurrence of a dielectric barrier discharge just after start up is enhanced, and startability can be improved even if an automotive discharge lamp poor in startability does not contain mercury as the discharge medium and has sealed 13 atm or more of xenon as the first gas. And, since the inner tube 1 is offset to the lower side against the outer tube 5, it is possible to prevent simultaneously a problem that the upper part of the light-emitting unit 11 is bulged during its life time to come into contact with the outer tube 5 and a problem that the optical characteristics are deteriorated due to the floating of the arc which becomes particularly prominent in the mercury free lamp.

Third Embodiment

Figure 15:
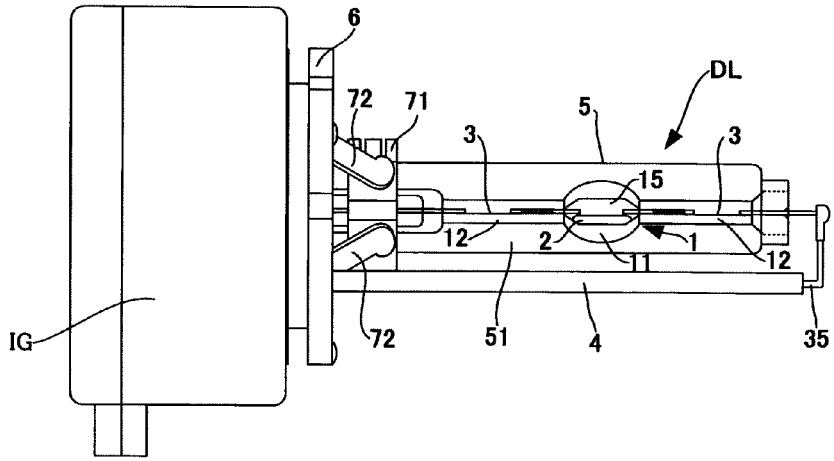
FIG. 15 is a side view illustrating a third embodiment of the discharge lamp device according to the invention.

FIG. 15 is a sectional view illustrating the discharge lamp device of a third embodiment according to the invention. It is apparent from FIG. 15 that this embodiment has basically the same structure as that of the first embodiment. Therefore, similular component parts of the third embodiment corresponding to those of the discharge lamp of the first embodiment are denoted by the same reference numerals, and their descriptions will be omitted.

This embodiment is a so-called D3 type discharge lamp device using a discharge lamp DL and an igniter IG integrally. The discharge lamp DL has a main portion which has substantially the same structure as that of the discharge lamp of the first embodiment. The igniter IG is a device for supplying the lamp with a high voltage pulse at start up and configured of a transformer, a resistor, a gap, a capacitor and the like.

At start up, the igniter IG generates a high voltage pulse of about 20 kV and a rise time of several tens to several hundreds nsec. When the rise time is short (especially, 200 ns or less, and further 100 ns or less), it is seen from the results of FIG. 12 that the occurrence of the dielectric barrier discharge becomes hard, and the NG start occurrence rate tends to become high. Therefore, the circuit is designed to have a long rise time. But, the adoption of the present invention enables to start without any problem even if it is combined with the igniter IG having a rise time of 200 ns or less.

Although the invention has been described in detail above by reference to the specific embodiments of the invention, the present invention is not limited to the embodiments described above. It is to be understood that modifications and variations of the embodiments can be made without departing from the spirit and scope of the invention.

What is claimed is:

1. An automotive discharge lamp, comprising:

an inner tube including a light emitting unit having a first space therein and seal portions formed on the light emitting unit;

a discharge medium containing a first gas enclosed in the first space;

a metal foil sealed in the seal portions;

electrodes with one end connected to the metal foil and other end extended into the first space; and an outer tube connected to the inner tube to form a second space between the outer tube and the inner tube, wherein the second space has a second gas enclosed therein and the second gas has a pressure of 0.3 atm or less, and an oxygen concentration in the second space is 1.0% or less, wherein the discharge medium does not substantially contain mercury, and the first gas has a pressure of 11 atm or more; and wherein the inner tube is offset downward with respect to the outer tube, and a distance D, determined between a point on an inner surface of the outer tube, which is a greatest distance from a closest point on an outer diameter portion of the light-emitting unit, and the closest point on the outer diameter portion of the light-emitting unit to the point on the inner surface of the outer tube, satisfies 1.5 mm≧D≧0.55 mm.

2. The automotive discharge lamp according to claim 1, further comprising:

a lead wire with one end connected to the metal foil and other end externally protruded out of the outer tube; and a support wire disposed outside the outer tube in parallel to a tube axis of the outer tube and connected to the other end of the lead wire, wherein a distance L between the support wire and the outer surface of the outer tube is 3.5 mm or less.

3. The automotive discharge lamp according to claim 1, wherein the second gas is one type of gas selected from neon, argon, krypton, xenon and nitrogen or a mixture gas thereof.

4. A discharge lamp device, comprising:

the automotive discharge lamp according to claim 1; and an igniter electrically connected to the automotive discharge lamp and charging a high voltage pulse having a rise time of 200 ns or less at start up.

5. An automotive discharge lamp, comprising:

an inner tube including a light emitting unit having a first space therein and seal portions formed on the light emitting unit;

a discharge medium containing a first gas enclosed in the first space;

a metal foil sealed in the seal portions;

electrodes with one end connected to the metal foil and other end extended into the first space; and an outer tube connected to the inner tube to form a second space between the outer tube and the inner tube, wherein the lamp is lighted in a condition that an axis of the outer tube is in a substantially horizontal state, wherein the second space has a second gas enclosed therein, and wherein the distance between a point on an inner surface of the outer tube, which is a greatest distance from a closest point on an outer diameter portion of the light-emitting unit, and the closest point on the outer diameter portion of the light-emitting unit to the point on the inner surface of the outer tube is greater than or equal to 0.55 mm and less than or equal to 1.5 mm.

* * * * *